US006397397B1

(12) United States Patent
Chen

(10) Patent No.: US 6,397,397 B1
(45) Date of Patent: Jun. 4, 2002

(54) LADIES' UNDERWEAR FABRICATION METHOD AND STRUCTURE

(76) Inventor: Mei-Hua Chen, No. 412, Guoshing Road, Guoshing Tsuen, Guoshing Hsiang, Nantou (TW)

( * ) Notice: Subject to any disclaimer, the term of this patent is extended or adjusted under 35 U.S.C. 154(b) by 0 days.

(21) Appl. No.: 09/982,021

(22) Filed: Oct. 19, 2001

(51) Int. Cl.[7] ..... A41C 3/00

(52) U.S. Cl. ..... 2/243.1; 450/1; 450/41; 450/70

(58) Field of Search ..... 2/243.1, 67, 105, 2/102, 255, 256, 258, 259; 450/65, 1, 66–68, 70, 41–43, 45–49, 51, 52, 53

(56) References Cited

U.S. PATENT DOCUMENTS 1,863,697 A * 6/1932 Rutledge ..... 450/70
4,419,997 A * 12/1983 Cole et al. ..... 450/70
4,909,771 A * 3/1990 Bergman ..... 450/70 X
5,479,791 A * 1/1996 Osborne ..... 450/70 X
5,553,468 A * 9/1996 Osborne ..... 450/70 X
5,820,444 A * 10/1998 McGaughey ..... 450/41 X

* cited by examiner

*Primary Examiner*—Gloria M. Hale
(74) *Attorney, Agent, or Firm*—Rabin & Berdo, P.C.

(57) ABSTRACT

A ladies' underwear fabrication method and structure that in addition to addressing the difficulty of effectively keeping conventionally fabricated women's underwear in position while worn also provides a newly researched and developed fabrication method that improves finished product appearance and comfort. A double-layer elastic fabric material is overlapped, a punch cutting pattern of a bust-shaped section is traced, breast cups are emplaced, and the fabric material is folded back and cut into shape. Tension-adjustable straps are then attached to the torso band section extending from the bottom of the brassiere and, furthermore, the upper end of the torso band section to effectively provide for stronger positioning and an enhanced bustline profile while the ladies underwear of the present invention is worn.

1 Claim, 8 Drawing Sheets

LADIES' UNDERWEAR FABRICATION METHOD AND STRUCTURE

FIELD OF THE INVENTION

The invention herein relates to a ladies' underwear fabrication method and structure that in addition to addressing the difficulty of effectively keeping conventionally fabricated women's underwear in position while being worn also provides a newly researched and developed fabrication method that improves the finished product appearance and comfort.

DESCRIPTION OF THE PRIOR ART

Referring to FIG. 8, the conventional concealed steel reinforcement-type brassiere structure is shown. Two breast cups B1 and steel reinforcements B2 are placed onto the inner layer B of the brassiere and then a similarly shaped outer layer A is utilized to cover the breast cups B1 and steel reinforcements B2 of the inner layer B. The underwear is sewn together by stitching the upper edge A1 and the two sides, thereby preventing the exposure of the brassiere steel reinforcements B2. The lower edge A2 of the underwear is of a stitchless hollow design and a torso band A3 is sewn along the bottom side, giving the brassiere a seamless appearance.

Although the brassiere structure is of a seamless design and the concealed steel reinforcements of the brassiere structure are not marked by stitches, it is attractive in appearance, but otherwise impractical. In this type of brassiere structure design, only the upper edge A1 of the brassiere is stitched and lower edge A2 is hollow and remains unstitched. As such, when the brassiere is worn by a woman, slight contortion or movement fits it on the body, but since the torso band A3 along the bottom side of the said brassiere is only coordinated with the outer layer A to form a two-layer underwear structure, effective positioning cannot be achieved, with the shortcomings including relatively easy loosening and shifting as well as no assistance in feminine bustline development. Furthermore, when the underwear is worn for extended periods, the readily occurring loss of tension in the brassiere torso band A3 causes the further drawbacks of folding over and movement out of position which reduces feminine bustline support and attractiveness.

SUMMARY OF THE INVENTION

The primary objective of the invention herein is to provide a ladies' underwear fabrication method and structure that in addition to addressing the difficulty of effectively keeping conventionally fabricated women's underwear in position while worn, also provides a new fabrication method that improves the finished product appearance and comfort. A double-layer elastic fabric material is overlapped, a punching cutting pattern of a bust-shaped section is traced on it, breast cups are emplaced, and the fabric material is folded back and cut into shape. Tension-adjustable straps are then attached to the torso band section extending from the bottom of the brassiere and, furthermore, the upper end of the torso band section to effectively strengthen positioning as well as enhancing bustline profile while the ladies' underwear of the present invention is worn, thereby providing for an even more practical ladies' underwear fabrication method.

DETAILED DESCRIPTION OF THE INVENTION

Figure 1:
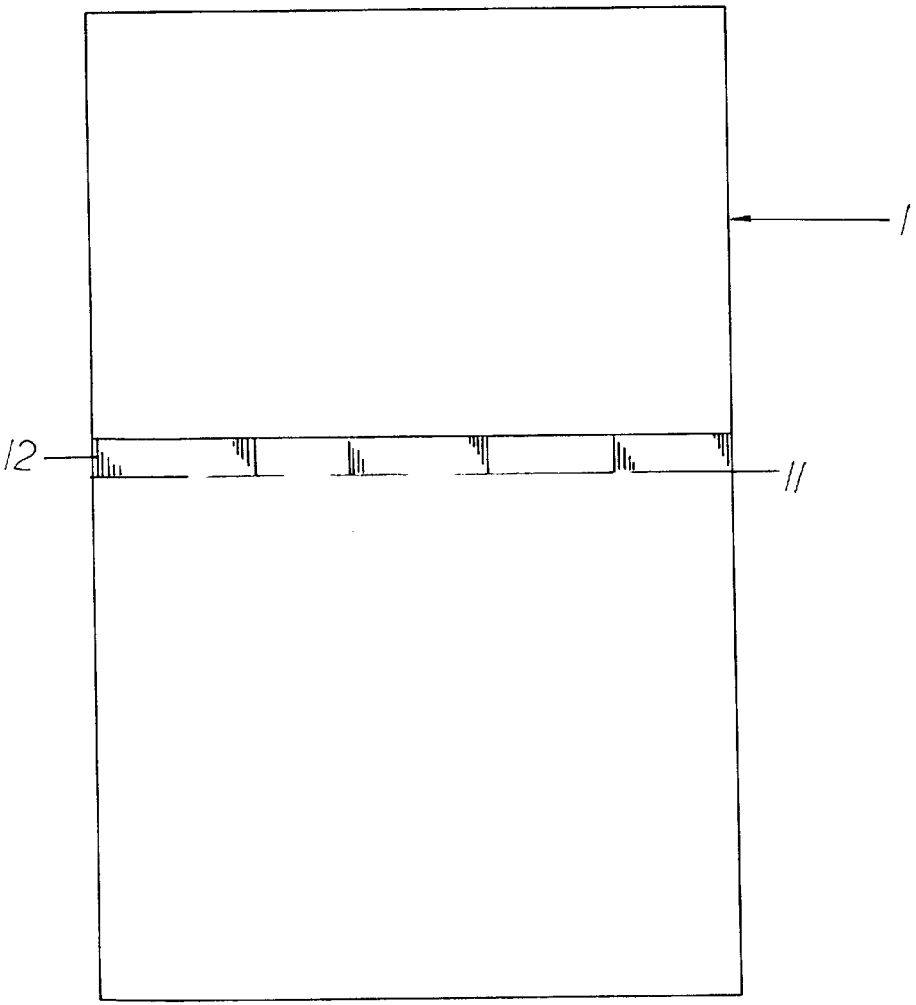
FIG. 1 is an orthographic drawing of the two-layer elastic fabric material of the invention herein.

The invention herein is a ladies' underwear fabrication method. The method includes: A) arranging of a two-layer elastic fabric material 1. The fabric material 1 is first doubled over to form an overlapped arrangement; B) Punch cutting. A midpoint fold line 11 is imposed horizontally along the center of the double-layer elastic fabric material 1 and a torso band section 12 extending from the midpoint fold line 11 is stitched. A punch cutting pattern of a bust-shaped section 13 is traced at the upper extent of the midpoint fold line 11. A punch cutting pattern for breast cup holes 14 is traced at the lower extent of the midpoint fold line 11; C) A breast cup 141 and a steel reinforcement 142 are placed onto each of the breast cup holes 14 and stitched into position; D) The two-layer elastic fabric material 1 is folded back along the midpoint fold line 11 such that elastic fabric material 1 is now in a four-layer disposition such that the bust-shaped section 13 is ready for cutting out; E) The excess material at the upper aspect of the bust-shaped section 13 is trimmed away and the underwear assumes its appearance; and F) After trimming, the back surface 2 of the two-layer elastic fabric material 1 is spread open along a cut-formed vertical center line 21 and a fastener 22 is disposed at the ends of the spread out back surface 2. Furthermore, tension-adjustable straps 15 are attached to the torso band section 12 extending from the bottom of the brassiere as well as the upper end of the torso band section 12 to complete the ladies' underwear product.

Figure 2:
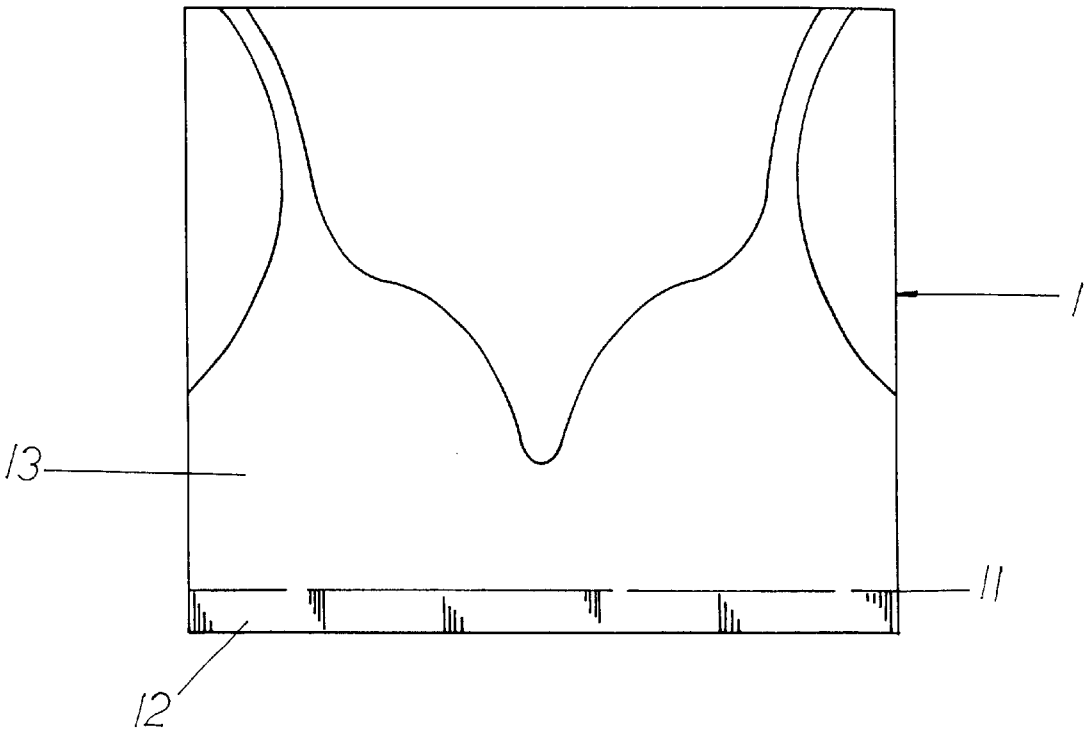
FIG. 2 is an orthographic drawing of the punch cut bust-shaped section utilized by the invention herein.
Figure 3:
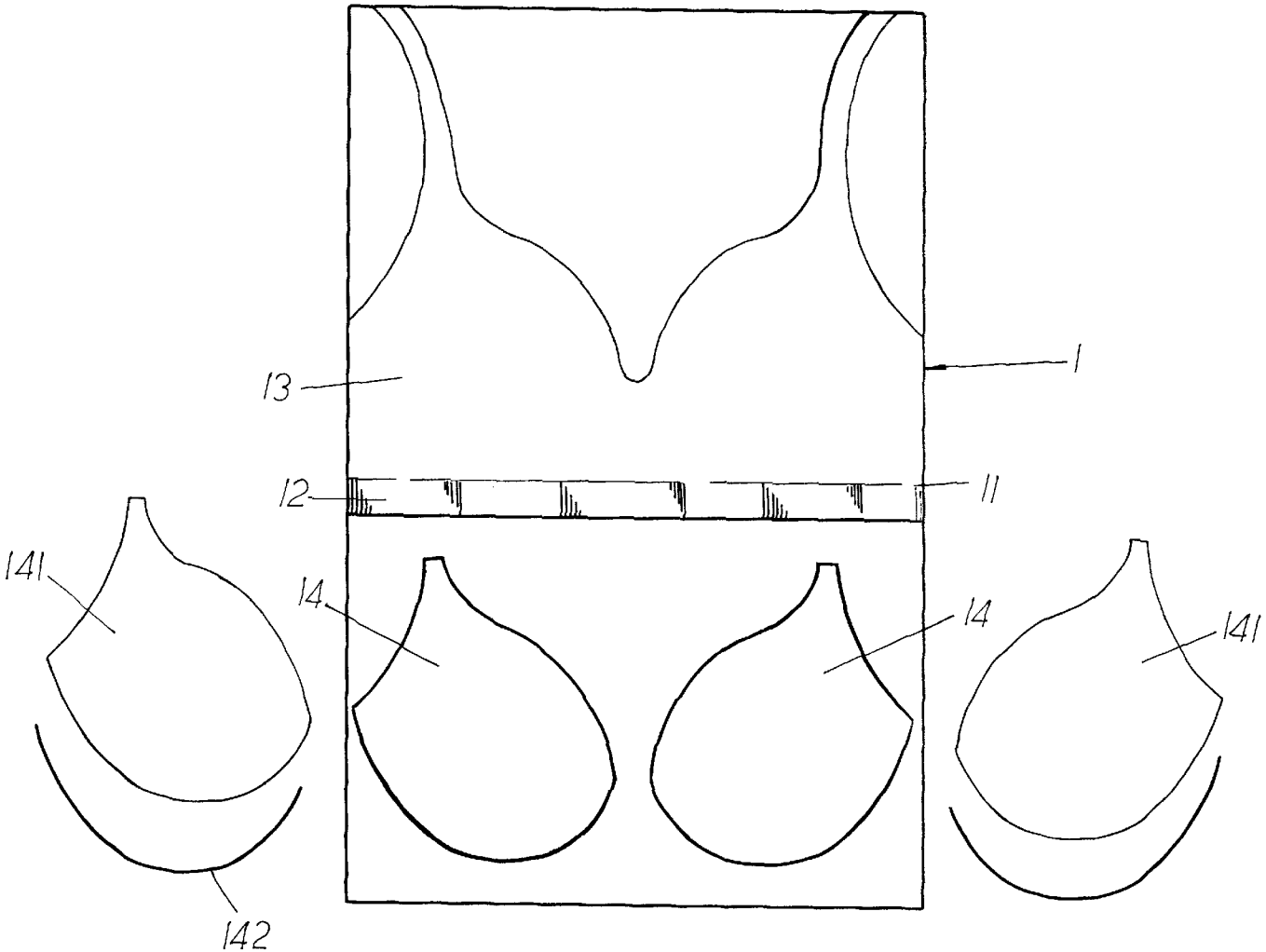
FIG. 3 is an orthographic drawing of the breast cup and steel reinforcement placed into the fabric material of the invention herein.
Figure 4:
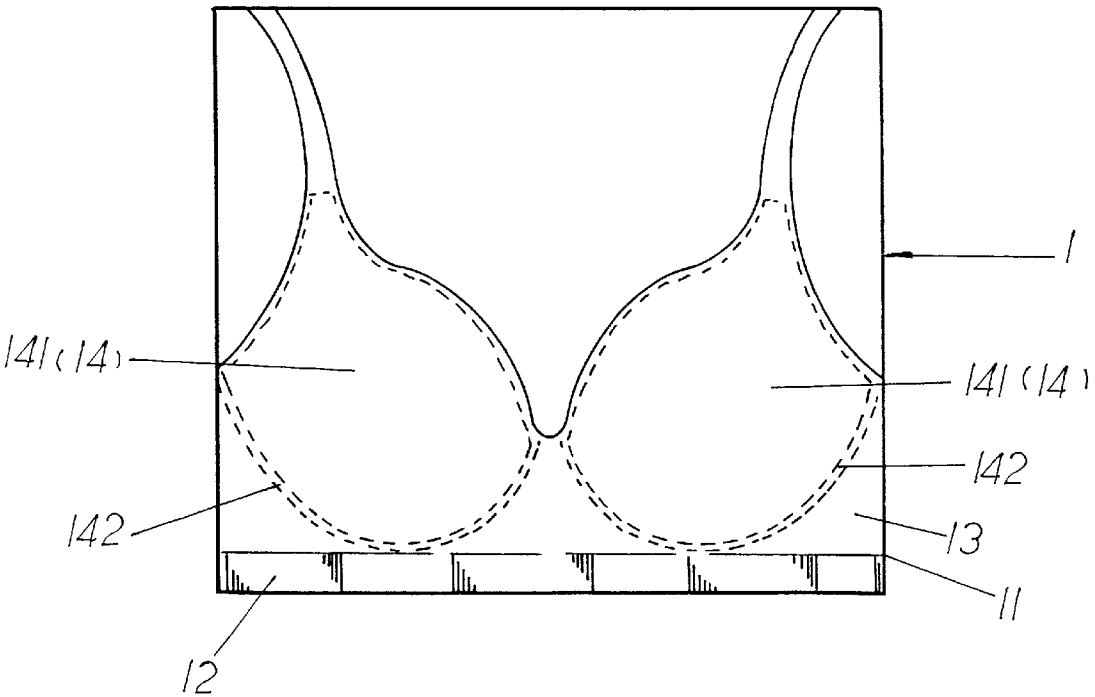
FIG. 4 is an orthographic drawing of the invention herein when folded over.
Figure 5:
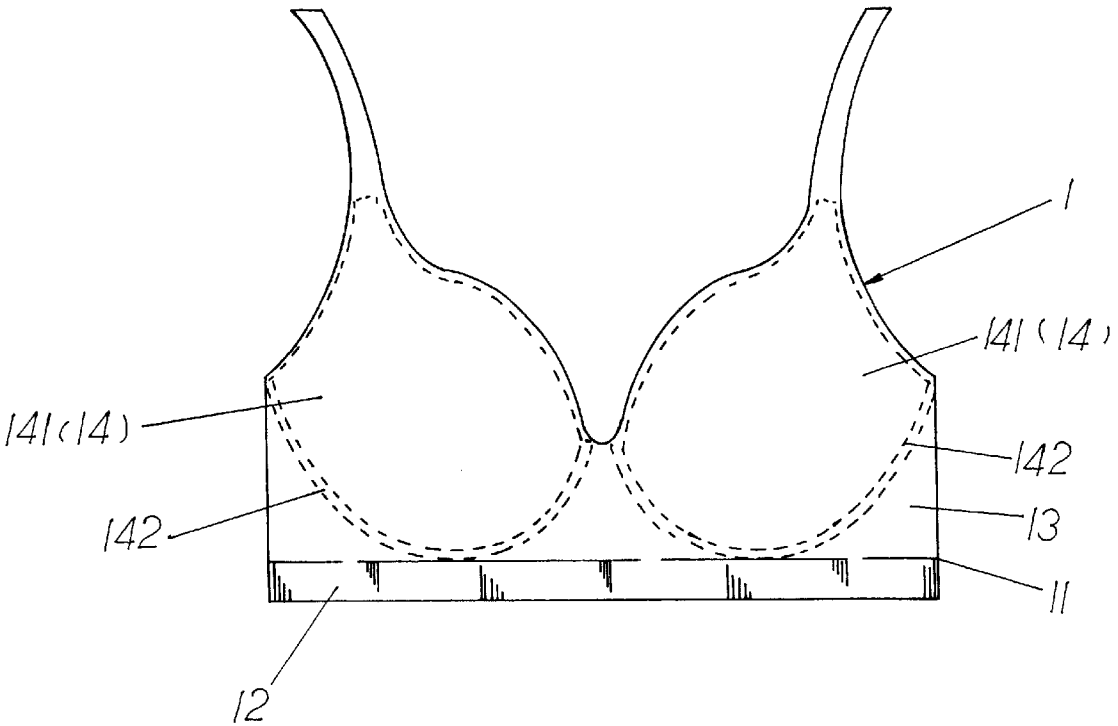
FIG. 5 is an orthographic drawing of the underwear of the invention herein after cutting.
Figure 6:
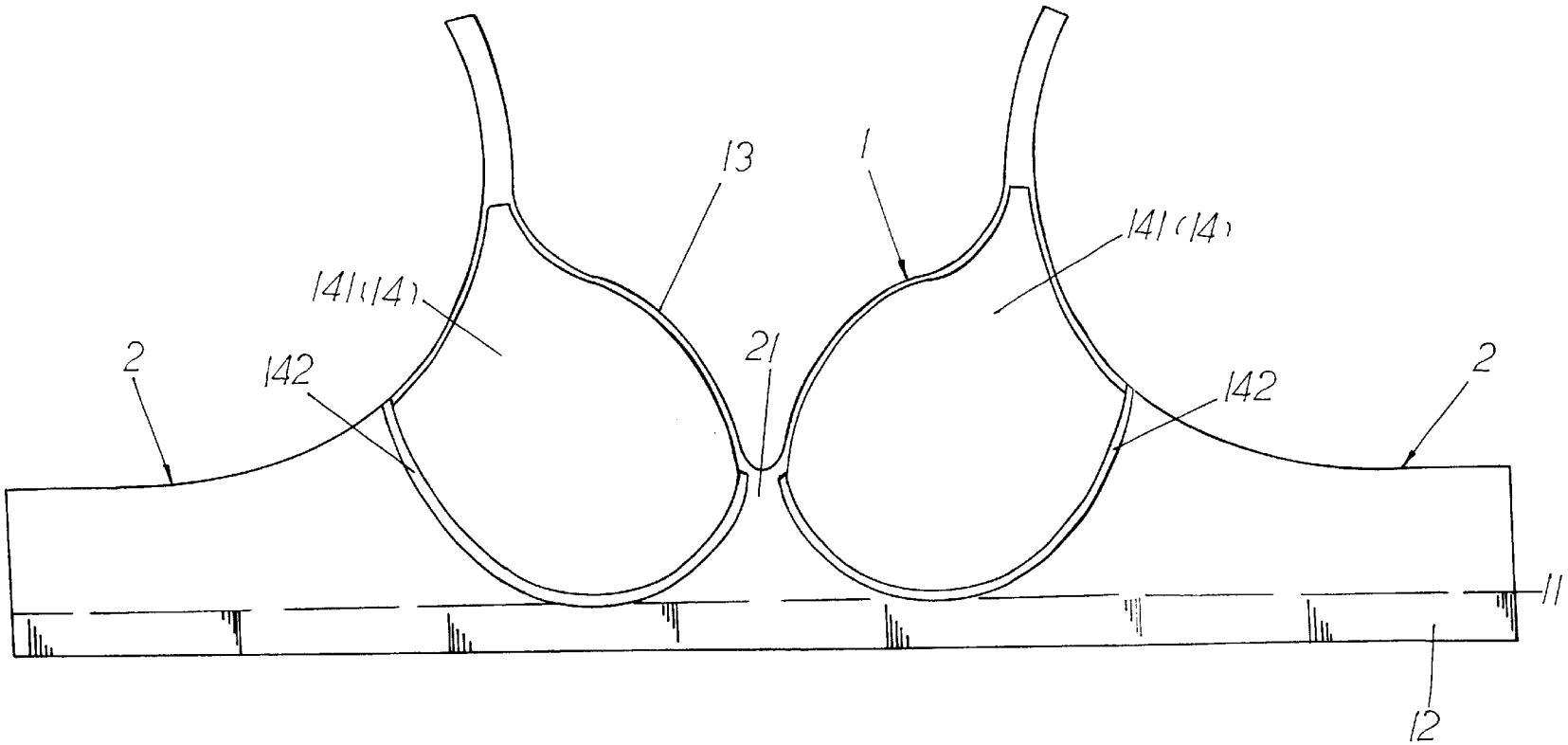
FIG. 6 is an orthographic drawing of the cut and spread open back surface of the invention herein.
Figure 7:
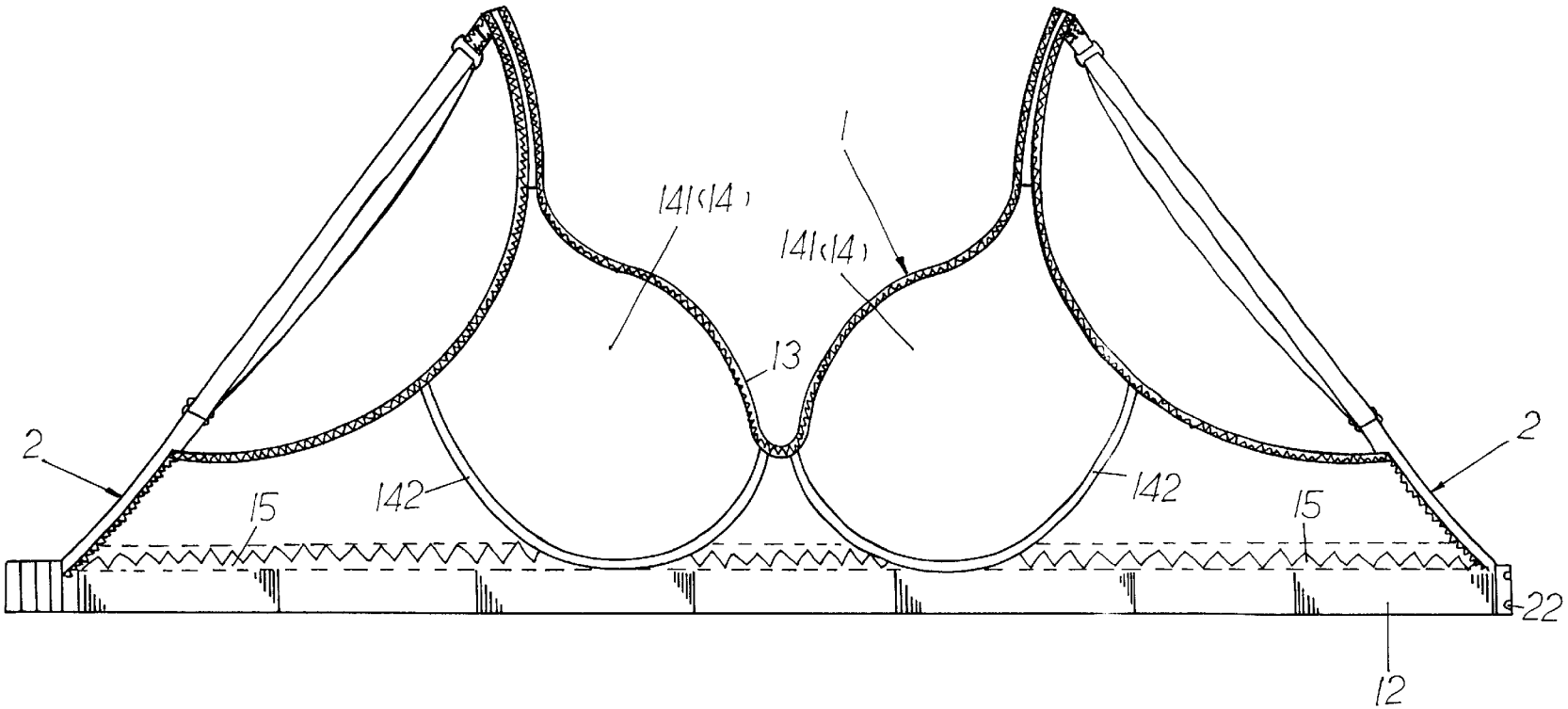
FIG. 7 is an orthographic drawing of an actual sample of the invention herein.
Figure 8:
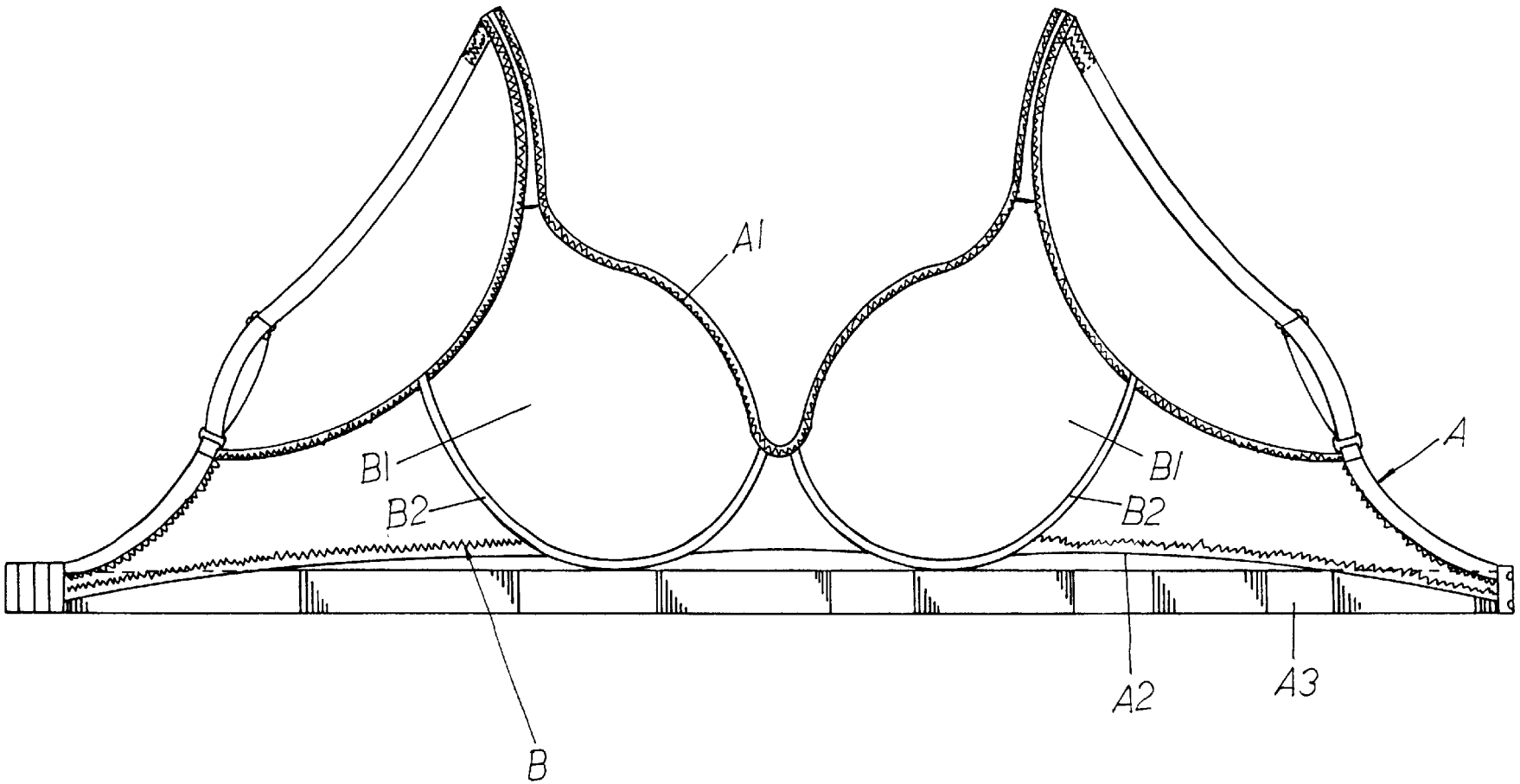
FIG.8 PRIOR ART
FIG. 8 is an orthographic drawing of an actual conventional, prior art sample.

The procedures involved in the ladies' underwear fabrication method and structure of the invention herein are shown sequentially in FIG. 1, FIG. 2, FIG. 3, FIG. 4, FIG. 5, FIG. 6, and FIG. 7.

Since the underwear produced through the said fabrication method is processed into a brassiere by punch cutting and tension-adjustable straps 15 are attached to the torso band section 12 extending from the bottom of the brassiere as well as the upper end of the torso band section 12 to effectively provide for stronger positioning while the ladies' underwear is worn without the drawbacks of underwear loosening and displacement, the present invention is greatly superior to conventional seamless underwear.

In summation of the foregoing section, since the ladies' underwear fabrication method and structure of the invention herein meets new patent requirements, the present invention is lawfully submitted to the patent bureau for review and the granting of the commensurate patent rights.

What is claimed is:

1. A method of making a brassiere, comprising:

doubling over a double-layer elastic fabric material to form an overlapped arrangement and to define a horizontal midpoint fold line along a center of the double-layer elastic fabric material;

stitching, to the elastic fabric material, a torso band section extending from the midpoint fold line;

tracing a punch cutting pattern of a bust-shaped section on the elastic fabric material and above the midpoint fold line;

tracing a punch cutting pattern for breast cup holes on the elastic fabric material and below the midpoint fold line;

fabric material is now in a four-layer disposition;

trimming away excess material at an upper aspect of the bust-shaped section;

after said trimming, spreading out a back surface of the elastic fabric material along a cut-formed vertical center line;

disposing a fastener at respective ends of the spread out back surface; and attaching tension-adjustable straps to the torso band section extending from a bottom of the brassiere as well as an upper end of the torso band section.

* * * * *